United States Patent [19]

Fürjes et al.

[11] 4,323,108

[45] Apr. 6, 1982

[54] TUNDISH AND PROCESS FOR CASTING FROM CHARGE TO CHARGE IN CONTINUOUS STEEL FOUNDRY

[75] Inventors: Emil Fürjes; István Kecskés, both of Ózd, Hungary

[73] Assignee: Ózdi Kohászati Üzemek, Ózd, Hungary

[21] Appl. No.: 144,372

[22] Filed: Apr. 28, 1980

[30] Foreign Application Priority Data

May 2, 1979 [HU] Hungary ..... OI225

[51] Int. Cl.[3] ..... B22D 11/10

[52] U.S. Cl. ..... 164/488; 164/437; 222/607

[58] Field of Search ..... 164/437, 82; 266/236, 266/275; 222/590, 607

[56] References Cited

U.S. PATENT DOCUMENTS 3,583,470 6/1971 Böhler ..... 164/437 X
3,887,171 6/1975 Neuhaus ..... 164/437 X

FOREIGN PATENT DOCUMENTS 540415 5/1957 Canada ..... 164/82
863119 1/1953 Fed. Rep. of Germany ..... 164/437
173322 11/1960 Sweden ..... 164/82
762311 11/1956 United Kingdom ..... 222/607

*Primary Examiner*—Robert D. Baldwin
*Assistant Examiner*—J. Reed Batten, Jr.

[57] ABSTRACT

With the solution of the invention the casting from charge to charge in the continuous foundries can be carried out with a much longer action time than presently, thus longer time will be available for opening of the ladle and setting it up for pouring. In the equipment consisting of intermediate ladle, casting platform and casting stand, the intermediate ladle is provided with such sidewise extending pouring gate, at the end of which a conchoidal recess is arranged. After the conchoidal recess a runner section is arranged its initial cross section being smaller than that of the conchoidal recess, its horizontal section is expanding, while its bottom part rises toward the intermediate ladle. Next to the first casting platform and casting stand a second casting platform and casting stand are arranged above the pouring gate. The pouring is carried out by placing the casting ladle containing the next charge onto the second casting stand before pouring of the first charge is completed, and the metal melt is poured into the pouring gate.

7 Claims, 5 Drawing Figures

PRIOR ART
Fig. 2
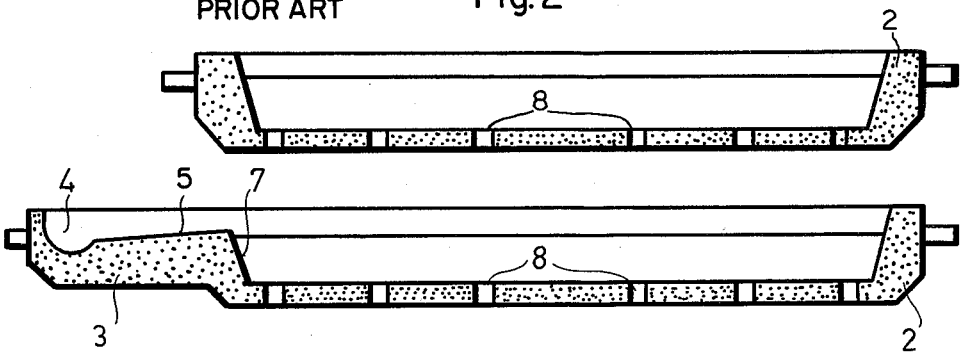
Fig. 3
PRIOR ART
Fig. 4
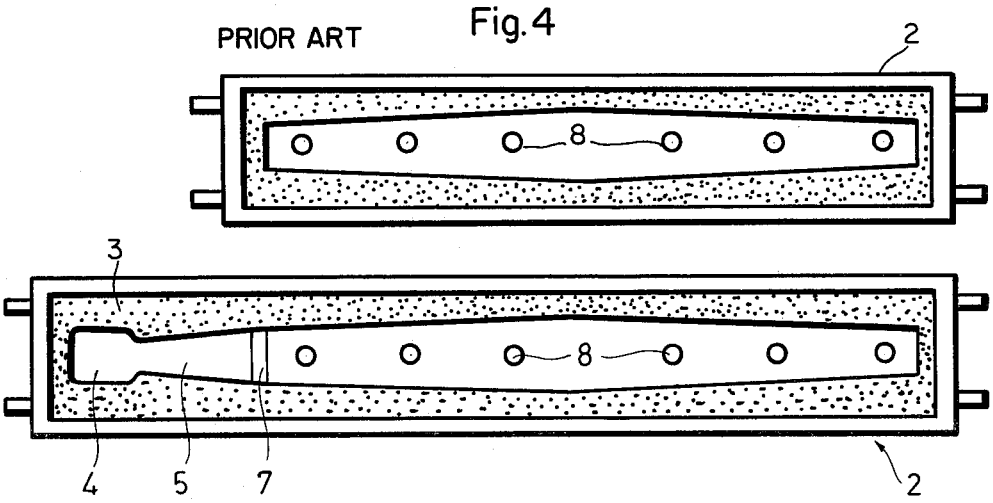
Fig. 5

TUNDISH AND PROCESS FOR CASTING FROM CHARGE TO CHARGE IN CONTINUOUS STEEL FOUNDRY

The invention relates to an improved tundish equipment and process for casting from charge to charge in continuous steel foundry, especially in the type of foundry installed in Siemens-Martin furnaces.

It is generally known that the liquid metal (steel melt) in the continuous foundry passes from the casting ladle first into the so-called intermediate ladle or tundish then proceeds into the open, water cooled ingot mold (crystallizer).

In the ingot mold first the outer part of the metal melt solidifies and the cast ingot with solid crust is further cooled beneath the ingot mold. After the secondary cooling the ingot solidified through the full cross section is cut up according to the specified sizes, or rolled through a train of rolls.

The continuous steel works are generally erected near converters or electric furnaces, since servicing of the continuous casting with them is efficiently realizable. The correctly programmable production time necessary for the converters and electric furnaces enables the tapping of the charges at specified intervals, as well as the continuous delivery of the steel to the foundry.

In the known solutions the metal melt is delivered from the casting ladles to the intermediate ladle with the aid of such device, which enables to begin the pouring of one charge after the other one practically immediately. This is essential, because the metal melt in the intermediate ladle or tundish is a given maximum 3–4 minutes for the pouring. If pouring of the next charge does not begin within the said time, the whole foundry has to be stopped, the frozen metal melt removed and the intermediate ladle is to be preheated. Naturally this involves extremely significant loss of time and high cost.

According to one of the known solutions the two casting ladles containing the metal melt are placed into a turning car. When the metal melt has flowed out of the first ladle, the device moving on the circular track turns 180° within a short time and the second ladle passes over the intermediate ladle. While the second charge is passed into the intermediate ladle, the first casting ladle can be filled up again.

The second known solution functions in principle similarly. Here the device to accommodate the two ladles moves on a straight track section delivering the required casting ladle or tundish over the intermediate ladle. Naturally, also in this case too the process has to be completed in 3–4 minutes.

The previous two basic solutions have several variants, these however differ from one another only in minor details, but their basic principle is identical with those described above.

As mentioned, the above described solutions are adequate if the equipment for ladling is erected near steel converters or near electric furnaces, provided however that the process timing of tapping, ladling and casting be kept within the strictly available time limits of 3–4 minutes. However, the ladling of the steel melt becomes an even more complicated task, with the presently known tundishes when a foundry employs Siemens-Martin type furnaces, because of the different time cycle employed in the casting operation.

The invention is aimed at such solution, whereby the casting from charge to charge in the continuous foundry can be accomplished during a much longer operating time, than presently, and thus more time will be available for opening of the ladle and for setting it up for casting.

The task according to the invention is solved in such a way that in the equipment consisting of intermediate ladle, casting platform and casting stand, the intermediate ladle is provided with a pouring gate extending laterally, which has a recess, preferably a conchoidal recess at the end. There is a runner section after the conchoidal recess the initial cross section of which is smaller than that of the conchoidal recess, the horizontal section is expanding, while at the bottom it rises toward the intermediate ladle. Along the first casting platform and casting stand a second casting platform and casting stand are arranged above the pouring gate.

In a suitable embodiment of the equipment according to the invention the bottom part of the runner is formed with about 2% slope. The inner wall or jacket of the runner section is connected to the inner wall or jacket of the intermediate ladle with an unbroken continuously sloping surface. At the place of connection the intermediate ladle is formed with a wall preferably with a 110° angle of inclination.

The casting from charge to charge according to the invention—when each charge of the metal melt is poured from the casting ladle into the intermediate ladle—takes place by positioning the casting ladle with the next charge onto the second casting stand, before pouring of the first charge is completed, and the metal melt is poured into the pouring gate connected to the intermediate ladle, then the further charges similarly before outflow of the previous charge, are poured alternately into the central part of the intermediate ladle and into the pouring gate.

In the course of implementation of the process pouring of the second and further charges can be commenced before pouring out of the previous charge is completed. The pouring—depending on the arrival of the charge—may take place simultaneously from both ladles at an interval of 5–40 minutes, since the solution according to the invention ensures the possibility for the arrangement of the two casting ladles simultaneously and next to each other, thus the safe casting technological conditions can be fulfilled.

Further details of the invention are described with the aid of and with reference to the accompanying drawings in which:

FIG. 2 is a cross-sectional view of a conventional intermediate ladle.

FIG. 3 is a cross-sectional view of an intermediate ladle according to the invention.

FIG. 4 is a plan view of the conventional intermediate ladle shown in FIG. 2.

FIG. 5 is a plan view of the intermediate ladle according to the invention shown in FIG. 3.

Figure 1:
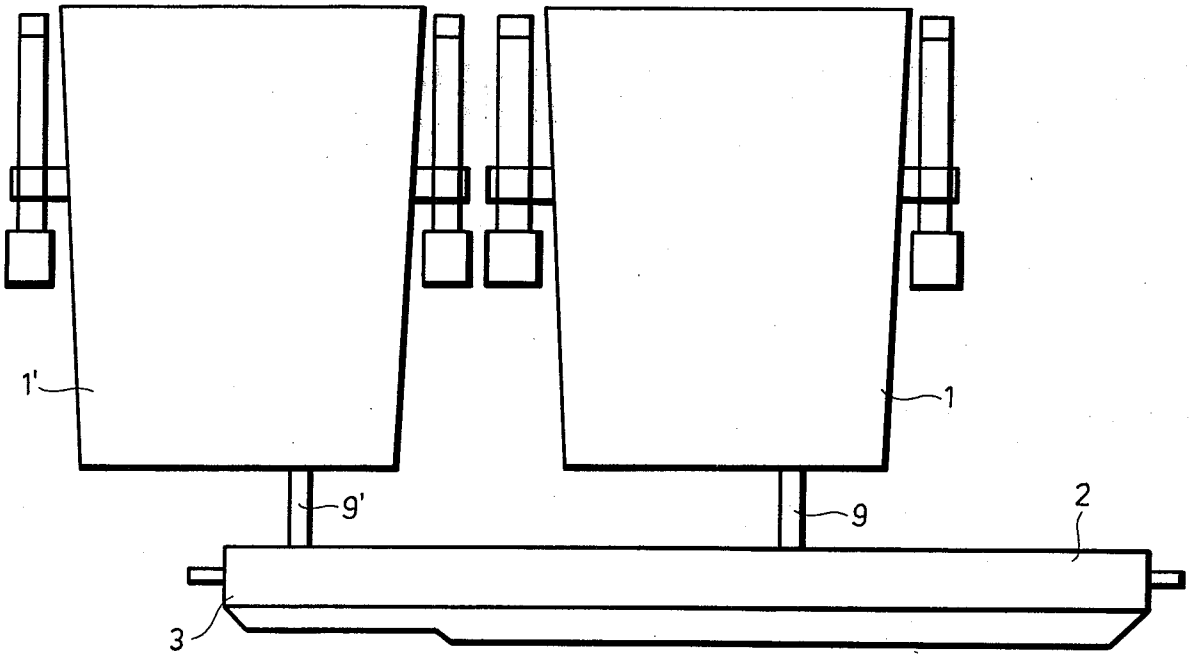
FIG. 1 is a diagrammatic representation of an embodiment of the equipment according to the invention.

FIG. 1 illustrates the metal melt flowing from the casting ladle 1 into the intermediate ladle 2. The jet of melt 9 is heading in the conventional way to the central part of the intermediate ladle 2 and after spreading in it, flows through the discharge holes 8 into the ingot mold arranged beneath the intermediate ladle 2, as shown in FIGS. 2–5. FIG. 1 shows the first casting ladle 1 and next to it the second casting ladle 1', from which the pouring of the metal melt into the conventional intermediate ladles—as shown in FIGS. 2 and 4—could not be accomplished.

However the intermediate ladle 2 according to the invention is provided with the pouring gate 3, which enables the jet of steel melt 9' flowing out of the second casting ladle 1', to flow into the intermediate ladle 2, before the pouring of the first charge is completed.

Shape of the pouring gate 3 of intermediate ladle 2 is shown in FIGS. 3 and 5. The pouring gate 3 is formed in such a way that no intensive splashing should occur at the outset of the casting, at the same time however the vertical and horizontal walls of the pouring gate should ensure the continuous progress of the melt without turbulent flow toward the discharge holes 8 at the bottom of the intermediate ladle 2.

For this reason the pouring gate 3 begins with a recess, preferably a conchoidal recess 4, in which at the outset of the casting a pool is formed within 2–3 seconds, said pool containing adequate quantity of metal melt.

Further flow of the metal melt from the pool formed in the conchoidal recess 4 is ensured by the runner section 5 formed as a diffuser. The initial cross section of the runner section 5 is smaller than that of the conchoidal recess 4 and the bottom part is rising suitable toward the intermediate ladle. The continuous supply of the metal melt in the intermediate ladle 2 is ensured with such runner section 5, the bottom part of which has preferably a 2% rise. Admission of the metal melt to the upper part of the intermediate ladle, thus in the vicinity of the melt level ensures at the same time the favorable flow conditions also in the vicinity of the discharge holes 8. The runner section 5 is connected to the conchoidal recess 4 and to the central part of the intermediate ladle 2, suitably with unbroken, continuous sloping surface.

At the extended part, i.e. at the junction of the pouring gate 3 and intermediate ladle 2, the wall 7 is formed preferably at an 110° angle of inclination.

Length of the pouring gate 3 is selected as to have a distance of about 70 cm between the extreme part of the metal melt flowing out of the discharge holes 8 and that point of the intermediate ladle 2, where the melt arriving from the pouring gate 3 reaches the pouring height.

Casting with the hereinabove described equipment takes place as follows:

Pouring of the metal melt from the first casting ladle 1 begins after the intermediate ladle 2 is sufficiently preheated. Since the level of the metal melt reached the required value in the intermediate ladle, crystallization into the ingot molds begins. 5 minutes before completing the pouring of the first charge, pouring of the second charge begins from the second casting ladle 1', set next to the first casting ladle 1. The pouring is continued from the second casting ladle 1' when the first charge is exhausted.

The melt flows from the conchoidal recess 4 of the pouring gate 3 connected to the intermediate ladle 2 through the runner section 5 into the interior of the intermediate ladle 2, whereby continuously ensuring an adequate charging level, the height of the metal melt is balanced and enables the continuous pouring.

Shape of the pouring gate 3 of the intermediate ladle 2 according to the invention allows the pouring conditions of the first charge to remain constant, while at the same time the conditions of the second and all the following pourings should meet the quantitative, temperature and flow technical requirements for a continuous pouring.

Naturally the continuous pouring can be continued as described above, after pouring down the second charge: the poured down casting ladle 1' is removed by the casting crane and replaced with a new casting ladle filled with metal melt.

The solution according to the invention makes it possible that—in function of the programming and durability of the discharge holes of the intermediate ladle—3–5 charges or even more may be continuously poured.

In view of the foregoing it is apparent, that the solution according to the invention substantially facilitates the balancing of the different cycle times of the continuous steel foundries and Siemens-Martin furnaces. By application of the process, instead of 3–4 minutes available in the conventional methods, 10–40 minutes operation time is available. The pouring can be carried out parallel from the two casting ladles even for 20–30 minutes without interruption of the pouring. In this way the flexibility of the technology is significantly increased and the possibility is given to vary the manipulation time for the ladle opening and for setting it up for pouring. This is an extremely important factor, since the exchange of the ladles due to the slow crane movement, requires a relatively long time, 10–15 minutes at the 100 ton ladles.

Construction of the equipment according to the invention is extremely simple and inexpensive, even if already existing device has to be converted.

Implementation of the process according to the invention needs no significant surplus cost or investment, nor any extensive conversion and lengthy shut-down. Thus the process is realizable even in such plants, where the described requirements were not taken into account at the original installation.

One further advantage of the solution according to the invention is that the usual preparatory functions (breaking, walling, drying, installation of zirconium oxide shell, heating, etc.) are not necessary after pouring out the content of every single casting ladle. The productivity is improved, since as a result of the increased pouring safety, 3–6 charges, or even more can be poured off at continuous rate.

The 20–30 minute parallel pouring ensured by the process according to the invention provides further advantages in case when the temperature of the first pouring is at the minimum limit of the specified temperature. The possibility is given to tap the next charge at a higher temperature and due to the simultaneous pouring, the temperature of the liquid steel present in the intermediate ladle can be increased by mixing.

Finally it is emphasized that the process according to the invention is favourably applicable not only to steel foundries erected next to the Siemens-Martin furnaces, but to any continuous foundry, because the process makes it possible to have sufficient time available for the manipulation work, increasing the safety of the pouring at the same time. In the Siemens-Martin steel works the continuous pouring without the process according to the invention is not realizable at all, or only at the expense of extremely uneconomic operation, while in the converter and electro-steel works its application permits the consecutive pouring of several charges with higher safety.

We claim:

1. In a tundish for the pouring of a steel melt from a tapping ladle to a mold, which comprises an elongated box-like container with a plurality of openings at the bottom thereof for the discharging of said melt, the improvement comprising an elongated pouring gate extending from one extremity of said container; a recess in said extending pouring gate to receive a steel melt stream from a tapping ladle; and an upwardly sloping and upwardly broadening runner section in said elongated pouring gate connecting said recess to said container and having a sharp sloping wall at the end thereof opposite said recess.

2. The improvement as claimed in claim 1, wherein the upward slope of said runner section has a rise of about 2%.

3. The improvement as claimed in claim 1, wherein the inner wall of said runner section is connected to the inner wall of said box-like container with an unbroken and continuously sloping surface.

4. The improvement as claimed in claim 1, wherein said sharp sloping wall of said runner section has an angle of inclination of about 110 degrees.

5. The improvement as claimed in claim 1, wherein said recess is a conchoidally shaped recess.

6. Process for pouring continuously a steel melt from a tapping ladle to a mold, which comprises the steps of:

(a) providing a tundish which comprises an elongated box-like container with a plurality of openings at the bottom thereof and an elongated pouring gate extending from one extremity thereof, a recess in said pouring gate and an upwardly sloping and upwardly broadening runner section connecting said recess to said container and having a sharp sloping wall at the end thereof opposite said recess;

(b) pouring said melt from a first charged tapping ladle into an intermediate section of said tundish;

(c) moving a second charged tapping ladle in position next to said first tapping ladle before the pouring from said first ladle is completed;

(d) pouring the melt from said second tapping ladle into said recess of said pouring gate of said tundish, thus causing said melt to flow through said upwardly sloping runner section of said tundish and into said intermediate section of said tundish; and (e) alternating the pouring of said melt from a tapping ladle between said intermediate section of said tundish and said recess of said pouring gate.

7. The process as claimed in claim 6, wherein the second and all following pourings of steel melt from a tapping ladle occur at intervals of from 5 to 40 minutes.

* * * * *